US010756461B2

(12) United States Patent
Buehman et al.

(10) Patent No.: US 10,756,461 B2
(45) Date of Patent: Aug. 25, 2020

(54) ADAPTER FOR SPLICE BLOCK OPENINGS

(71) Applicant: ERICO INTERNATIONAL CORPORATION, Solon, OH (US)

(72) Inventors: Ernest Richard-Dean Buehman, Macedonia, OH (US); Steven D. Rois, Mayfield Village, OH (US); Frederic Bizet, Chatillon (FR); Thomas Bockstoce, Akron, OH (US)

(73) Assignee: ERICO INTERNATIONAL CORPORATION, Solon, OH (US)

( * ) Notice: Subject to any disclaimer, the term of this patent is extended or adjusted under 35 U.S.C. 154(b) by 16 days.

(21) Appl. No.: 15/992,837

(22) Filed: May 30, 2018

(65) Prior Publication Data

US 2018/0351269 A1 Dec. 6, 2018

Related U.S. Application Data

(60) Provisional application No. 62/512,579, filed on May 30, 2017.

(51) Int. Cl.

| | |
|---|---|
| ***H01R 9/26*** | (2006.01) |
| ***H01R 9/24*** | (2006.01) |
| ***H01R 13/66*** | (2006.01) |
| ***H01R 13/447*** | (2006.01) |
| *H01R 4/36* | (2006.01) |

(52) U.S. Cl.

CPC ..... *H01R 9/2675* (2013.01); *H01R 9/2458* (2013.01); *H01R 9/26* (2013.01); *H01R 9/2616* (2013.01); *H01R 13/447* (2013.01); *H01R 13/665* (2013.01); *H01R 4/36* (2013.01)

(58) Field of Classification Search

CPC .. H01R 9/2675; H01R 9/2458; H01R 13/447; H01R 9/2616; H01R 9/26; H01R 4/36

See application file for complete search history.

(56) References Cited

U.S. PATENT DOCUMENTS

| | | | | |
|---|---|---|---|---|
| 2,552,061 A * | 5/1951 | Popp | H01R 13/447 | 439/136 |
| 4,094,569 A * | 6/1978 | Dietz | H01R 13/447 | 439/137 |
| 4,279,457 A * | 7/1981 | Nickence | H01R 13/447 | 439/145 |
| 4,600,258 A * | 7/1986 | Hu | H01R 13/447 | 439/135 |

(Continued)

FOREIGN PATENT DOCUMENTS

GB 2322484 A 8/1998

OTHER PUBLICATIONS

Autonomous Power Systems | The New Generation of Solar Energy; SunWize Age of Power Autonomy; product search web pages; retrieved from the internet Aug. 22, 2018; 10 pages.

(Continued)

*Primary Examiner* — Briggitte R. Hammond
(74) *Attorney, Agent, or Firm* — Quarles & Brady LLP

(57) ABSTRACT

An adapter for a housing opening in a housing of a splice block can include an adapter body that is movably coupled to the housing and includes a conductor passage. The adapter body can be selectively movable between a closed configuration and an open configuration, in which the conductor passage is, respectively, in and out of alignment with the housing opening.

20 Claims, 9 Drawing Sheets

(56) References Cited

U.S. PATENT DOCUMENTS 4,632,479 A * 12/1986 Jacobson ..... H01R 13/447 439/145
4,854,899 A 8/1989 Matthews
5,551,889 A 9/1996 Kozel et al.
5,647,045 A * 7/1997 Robinson ..... G02B 6/4454 385/135
5,727,314 A 3/1998 Ashcroft
5,866,846 A * 2/1999 Huag ..... H01R 13/4532 174/67
5,906,503 A 5/1999 Wiencek et al.
5,906,508 A * 5/1999 Jeffcoat ..... H01H 9/085 200/308
5,997,318 A * 12/1999 Chou ..... H01R 13/5213 439/136
6,038,125 A * 3/2000 Anzai ..... H05K 5/0208 174/660
6,281,444 B1 8/2001 Yamanashi
7,059,889 B1 6/2006 Pavlovic et al.
7,090,544 B2 8/2006 Campbell et al.
7,134,921 B2 11/2006 Siracki et al.
7,144,269 B2 12/2006 Libby et al.
7,416,434 B2 8/2008 Saha et al.
7,452,221 B1 * 11/2008 Oddsen ..... H01R 13/4534 439/137
7,611,363 B2 11/2009 Nakamura
7,766,687 B2 8/2010 Verjans et al.
8,714,996 B2 5/2014 Bishop
8,858,255 B2 10/2014 Boutin et al.
9,025,320 B2 * 5/2015 Neukam ..... G06F 1/181 361/679.02
9,667,009 B1 * 5/2017 Read ..... H01R 33/00
10,302,886 B2 * 5/2019 Kubinski ..... G02B 6/4454
2004/0203270 A1 * 10/2004 Wang ..... H01R 13/4534 439/136
2006/0246766 A1 11/2006 Neer et al.
2009/0311892 A1 * 12/2009 Weeks ..... H01R 13/4534 439/137
2010/0053851 A1 * 3/2010 Bernstein ..... A61B 5/14532 361/679.01
2015/0064985 A1 3/2015 King, Jr. et al.
2015/0162670 A1 6/2015 Galla et al.
2015/0333421 A1 11/2015 Reynolds et al.

OTHER PUBLICATIONS

Eaton; Bussmann Series; Finger-safe power distribution blocks; Technical Data; 8 pages.
NVent; Power Block; product details; retrieved from the internet Aug. 22, 2018; 2 pages.
Dijkman Nederland Elektrotechniek bv; importer of electrical components; product search web pages; retrieved from the internet Aug. 22, 2018; <https://www.dijkman.com/energiedistributie/verdeelblokken>; 3 pages.

* cited by examiner

ADAPTER FOR SPLICE BLOCK OPENINGS

RELATED APPLICATIONS

This application claims priority to U.S. Provisional Patent Application No. 62/512,579, titled "Adapter for Splice Block Openings" and filed May 30, 2017, the entirety of which is incorporated herein by reference.

BACKGROUND

Splice blocks and other types of power distribution blocks (collectively referred to, herein, as "splice blocks") are generally configured to electrically connect different conductors, including conductors of different sizes and types. For example, conventional splice blocks can be configured to electrically connect stranded or solid cable of different diameters or cross-sectional profiles, flexible busbars, solid busbars of different dimensions or cross-sectional profiles, and so on.

In order to form the desired electrical connections, for example, a conventional splice block can include a block of conductive material enclosed by an insulating housing. Additional features can then be provided to mechanically and electrically connect multiple conductors to the conductive block. For example, some conventional splice blocks use "tunnel" type connections in which a hole is drilled into a metallic block to create a connection point. A conductor can be inserted into the hole, and a screw, oriented orthogonally to the conductor, can be tightened onto the conductor to secure the conductor in place.

To admit conductors into the housing to be connected to the relevant conductive blocks, openings are generally provided in the insulating housings of splice blocks. Due to the conductive nature of the blocks and the operational flow of electricity through the blocks, particular configurations of the openings may be required to meet IP20 ingress protection per IEC standards or to comply with other similar standards (e.g., to verify that the relevant splice blocks can be considered finger-safe). For example, some standards can prescribe requirements intended to prevent users from inserting fingers or similarly sized objects into the housing of an installed and operational splice block.

SUMMARY

Generally, embodiments of the invention provide adapters for splice blocks and corresponding splice block assemblies, to accommodate conductors of different sizes and types.

Some embodiments of the invention provide an adapter to selectively allow insertion of a first conductor and a second conductor into a splice block housing via a housing opening in the splice block housing, where the first conductor has a first cross-sectional size and the second conductor has a second, smaller cross-sectional size. An adapter body can be movably retained on the splice block housing and can include a first adapter opening that is smaller than the housing opening. The adapter body can be movable relative to the splice block housing from an open configuration to a closed configuration. The adapter body, in the open configuration, can be disposed to permit the first conductor to be inserted into the splice block housing via the housing opening. The adapter body, in the closed configuration, can be disposed to block insertion of the first conductor into the splice block housing via the housing opening, with the first adapter opening aligned for insertion of the second conductor the splice block housing via the first adapter opening and the housing opening.

Some embodiments of the invention provide a splice block assembly for use with a conductive block, a first conductor, and a second conductor, with the first conductor having a larger cross-sectional profile than the second conductor. A housing can be configured to insulate the conductive block, with the housing including a housing opening configured to admit either of the first and second conductors into the housing. An adapter body can be movably coupled to the housing and can include a first adapter opening that is configured not to admit the first conductor therethrough. The adapter body can be selectively movable relative to the housing between and open configuration and a closed configuration. In the open configuration, the adapter body can be disposed with the first adapter opening out of alignment with the housing opening, to allow either of the first and second conductors to extend into the housing via the housing opening. In the closed configuration, the adapter body can be in alignment with the housing opening, to block insertion of the first conductor through the housing opening and to admit the second conductor into the housing opening via the first adapter opening.

Some embodiments of the invention can provide a splice block assembly for use with a conductive block, a first busbar, and a second busbar, with the first busbar having a rectangular cross-sectional profile that is larger than a rectangular cross-sectional profile of the second busbar. A housing can be configured to insulate the conductive block, with the housing including a first housing track and a housing opening. The housing opening can be configured to admit either of the first and second busbars into the housing to engage the conductive block. An adapter body can include an outer frame and a first adapter opening, with at least part of the outer frame being slidably received within the first housing track of the housing to guide sliding movement of the adapter body between an open configuration and a closed configuration. In the open configuration, the adapter body can be disposed to permit the first busbar to be inserted into the housing via the housing opening. In the closed configuration, the adapter body can be disposed to block insertion of the first busbar into the housing via the housing opening, with the first adapter opening aligned for insertion of the second busbar into the housing via the first adapter opening and the housing opening.

DETAILED DESCRIPTION

Figure 1:
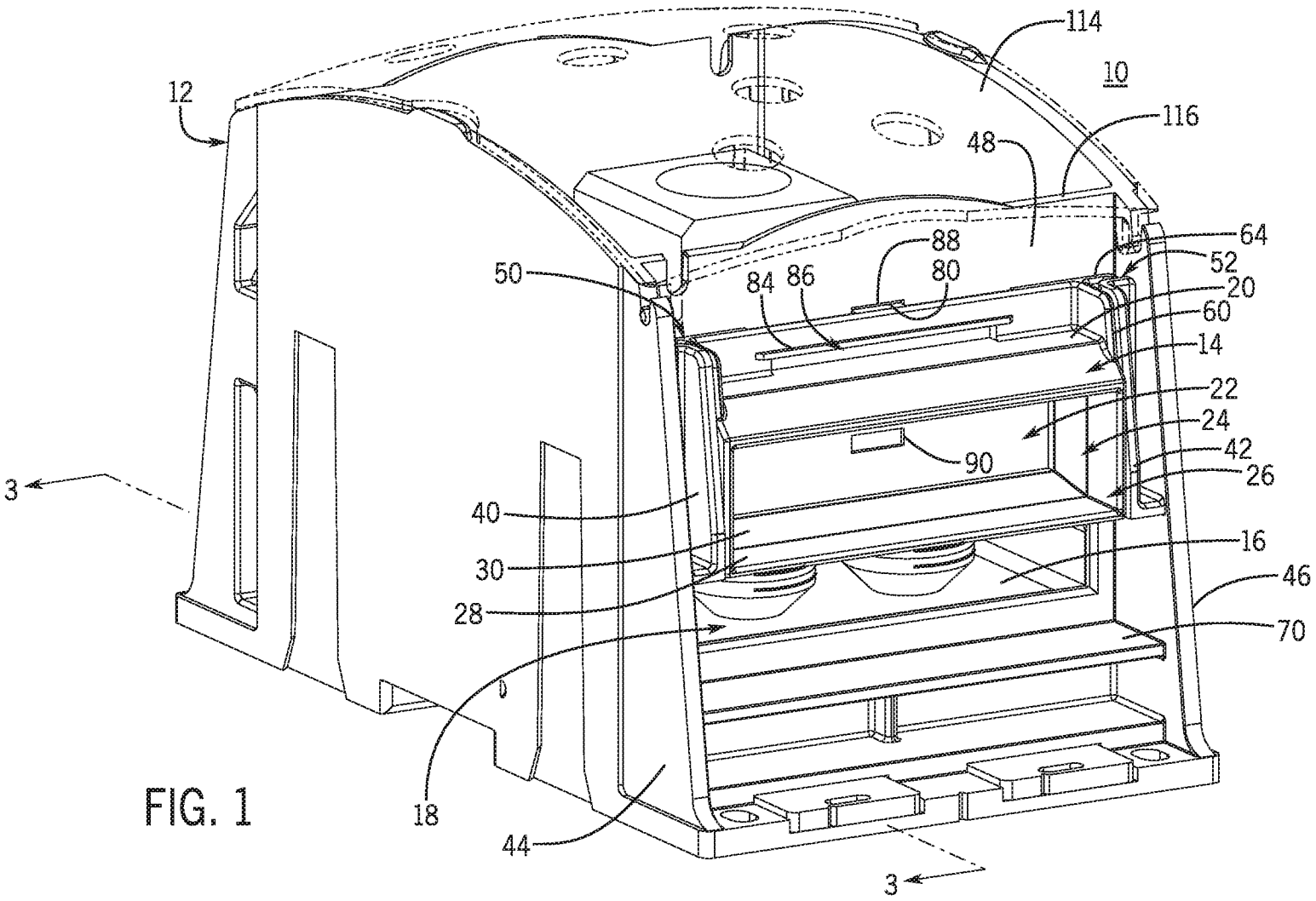
FIG. 1 is a front isometric view of a splice block assembly with an adapter, according to an embodiment of the invention, with the adapter in an open configuration.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

The following discussion is presented to enable a person skilled in the art to make and use embodiments of the invention. Various modifications to the illustrated embodiments will be readily apparent to those skilled in the art, and the generic principles herein can be applied to other embodiments and applications without departing from embodiments of the invention. Thus, embodiments of the invention are not intended to be limited to embodiments shown, but are to be accorded the widest scope consistent with the principles and features disclosed herein. The following detailed description is to be read with reference to the figures, in which like elements in different figures have like reference numerals. The figures, which are not necessarily to scale, depict selected embodiments and are not intended to limit the scope of embodiments of the invention. Skilled artisans will recognize the examples provided herein have many useful alternatives and fall within the scope of embodiments of the invention.

As also described above, standards such as those for IP20 ingress protection or a NEMA-1 enclosure ratings can impose requirements on design of splice blocks to help prevent operators from touching live electrical components. For example, some standards can require openings into splice block housings to be finger-safe once conductors are installed therein. However, it may be useful for some conductor openings to accommodate a range of conductor sizes. Further, in some situations, the size discrepancy between smallest and largest conductors to be accommodated by a particular housing opening can be significant. Accordingly, with smaller conductors installed, conventional splice block designs can leave a relatively substantial gap between the outer perimeter of the conductors and the inside perimeter of the relevant opening.

In this light, conventional splice block designs may not provide appropriately finger-safe (or otherwise appropriately configured) housings while also accommodating a wide range of conductor sizes. Embodiments of the invention can provide a splice block adapter that can address this issue, and others.

In some embodiments of the invention, for example, an adapter can be configured to selectively and partially block a portion of an opening in a housing (e.g. by effectively narrowing the splice block opening), while still allowing a relatively small conductor to be inserted into the housing. In this way, for example, the adapter can allow the housing to remain finger safe during use of the relatively small conductor, even if the housing opening is configured to receive a substantially larger conductor. Further, the adapter can also be configured to selectively unblock the housing opening in order for the housing opening to receive the larger conductor.

In some embodiments, using an adapter to selectively block (e.g., narrow) a housing opening can reduce or eliminate a gap that may result, in conventional designs, between the outer perimeter of a smaller conductor and the inside perimeter of the opening in the housing. In some embodiments, by reducing or eliminating this gap, IP20 ingress protection (or NEMA-1 or other ratings) can be obtained for a splice block across a wide range of conductor sizes.

In different embodiments, an adapter according to the invention can be configured to selectively block (e.g., narrow) an opening in a splice block housing in different ways. For example, in some embodiments, an adapter can be configured to slide relative to a splice block housing in order to selectively cover and uncover the splice block opening. Depending upon the embodiment, the adapter can slide in any number of directions relative to a nominal orientation of the splice block housing (e.g., up, down, right, or left).

In some embodiments, an adapter can be hinged to selectively cover the splice block opening. For example, an adapter can be hinged via its top, bottom, right, or left side, relative to a nominal orientation of the splice block. In some embodiments, an adapter can be configured to otherwise rotate, e.g., about an axis transverse to a plane of a relevant opening, in order to selectively cover the splice block opening.

In some embodiments, an adapter can slide along a path defined by an angled track of a housing. In some adapter embodiments, the adapter can slide along a path defined by a curved track of a housing.

In some embodiments, movement of an adapter according to the invention can be selectively inhibited. In one example, recesses or other catches can be integrally formed or otherwise disposed on a splice block housing or an adapter. Correspondingly, the adapter or the housing can include a protrusion that can removably engage one or more of the recesses to selectively inhibit movement of the adapter. In this regard, for example, engagement of a protrusion and a recess can prevent an adapter from being accidentally moved out of a particular orientation (e.g., a closed or open configuration). In some embodiments, a catch and a corresponding protrusion can be configured so that a tool (e.g. a screw driver) can be used to manually uncouple the protrusion from the catch.

In some embodiments, a latch can be used to prevent an adapter from moving. In some embodiments, snap-in features (e.g., integrally formed snap-in structures) can be used to prevent the adapter from moving.

In some embodiments, an adapter according to the invention can be removably coupled to a splice block housing. In some embodiments, an adapter can be attached to or otherwise secured to a housing of a splice block during a manufacturing process. In some embodiments, an adapter can be provided to users separately from a housing, thereby allowing for selective installation of the adapter for particular settings, as appropriate. In some embodiments, an adapter can be configured for retro-fit installation with an existing housing.

In some embodiments, a splice block housing or an adapter can be configured to prevent the accidental removal of the adapter from the housing. In some embodiments, for example, the housing can support a movable cover that can be selectively oriented to prevent removal of the adapter. In some embodiments, as also noted above, a housing or an adapter can have recesses or other catches that correspond to protrusions disposed on (e.g., integrally formed with) the adapter or the housing. Such an arrangement, for example, can similarly help to prevent removal of the adapter from the housing.

In different embodiments, an adapter according to the invention can exhibit any number of different sizes and relevant dimensions. As noted above, for example, conventional splice blocks and associated conductors can come in various sizes and shapes. Accordingly, to provide for interchangeability and interoperability with existing systems, embodiments of the invention can include adapters that exhibit a corresponding variety of sizes and shapes.

In some examples discussed herein, an adapter according to the invention is configured for use with a splice blocks that have screw-type connections for securing conductors. Some embodiments of the invention can be used with splice blocks that have different connection types, such as screw driven cage connections, spring clamp designs, stud-type connections, and the like. Similarly, unless otherwise specified or limited, other specific aspects of splice blocks discussed herein are presented as examples only.

FIGS. 1 through 4 illustrate an example configuration of a splice block assembly 10, according to one embodiment of the invention, including a housing 12 and an adapter 14. The housing 12, is configured as an insulating housing for a conductive block 16. Correspondingly, the housing 12 includes a main housing opening 18 and multiple other openings (not shown) configured to admit conductors (not shown in FIGS. 1 through 4) into the housing 12 to be secured to the block 16.

In the embodiment illustrated, the housing 12 is configured to be mounted directly to a panel or board using screws, or to attach to a structural rail (e.g. a top-hat style DIN rail, a G rail, or a strut track). In other embodiments, the adapter 14 or other adapters according to the invention can be used with housings having other configurations, including housings configured to be attached to other structures in other ways.

The adapter 14 is generally configured to be selectively moved into and out of alignment with the opening 18 in order to selectively at least partly partially block (e.g., narrow) the opening 18. Correspondingly, for example, the adapter 14 includes an adapter body 20 that is movable relative to the housing 12 and that surrounds and fully encloses an adapter opening 22. In the embodiment illustrated, the adapter opening 22 exhibits a generally smaller size (e.g., projected area) than the housing opening 18.

Accordingly, when the adapter opening 22 is aligned over (e.g., centered on) the housing opening 18, the adapter body 20 effectively reduces a maximum size of conductor that can be admitted into the housing 12 via the opening 18. In the embodiment illustrated, the adapter 14 can be moved between an open configuration (see, e.g., FIGS. 1 and 3) and a closed configuration (see, e.g., FIGS. 2 and 4), with the adapter body 20 partially blocking the opening 18 in the closed configuration but not in the open configuration. In other embodiments, other configurations are possible.

An opening in an adapter according to the invention can be exhibit any number of different configurations, as appropriate for an expected configuration of conductors to be used with the adapter. In the embodiment illustrated, similarly to the housing opening 18, the adapter opening 22 is substantially rectangular and is elongate along a width of the adapter body 20 (and the housing 12). This configuration may be appropriate, for example, for use with a substantially rectangular conductor such as a rectangular busbar (not shown in FIGS. 1 through 4). In other embodiments, other configurations are possible.

Figure 5B:
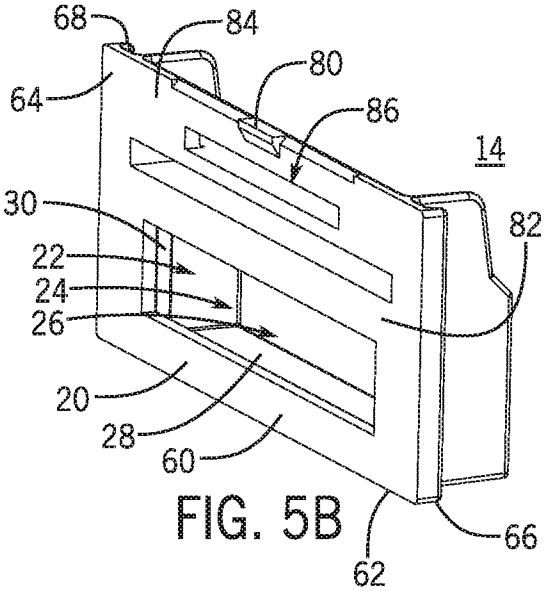
FIGS. 5A through 5C are front and rear isometric views and a front elevation view, respectively, of the adapter of FIG. 1.
Figure 5C:
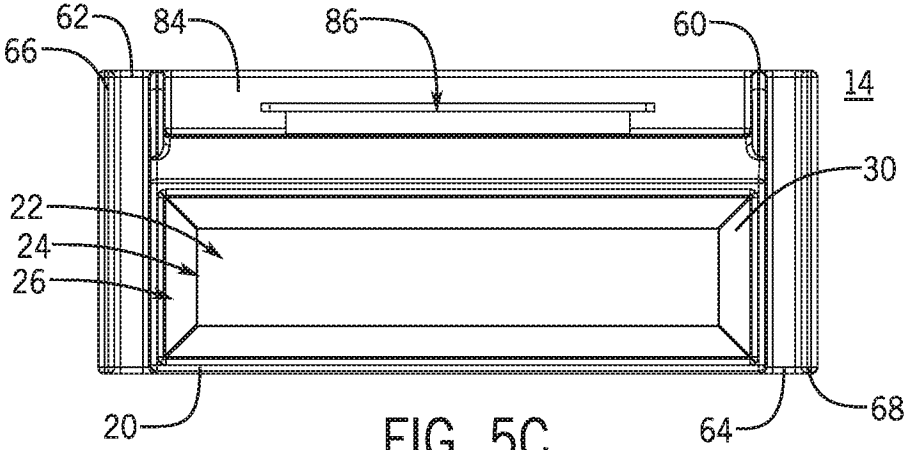
Figure 5A:
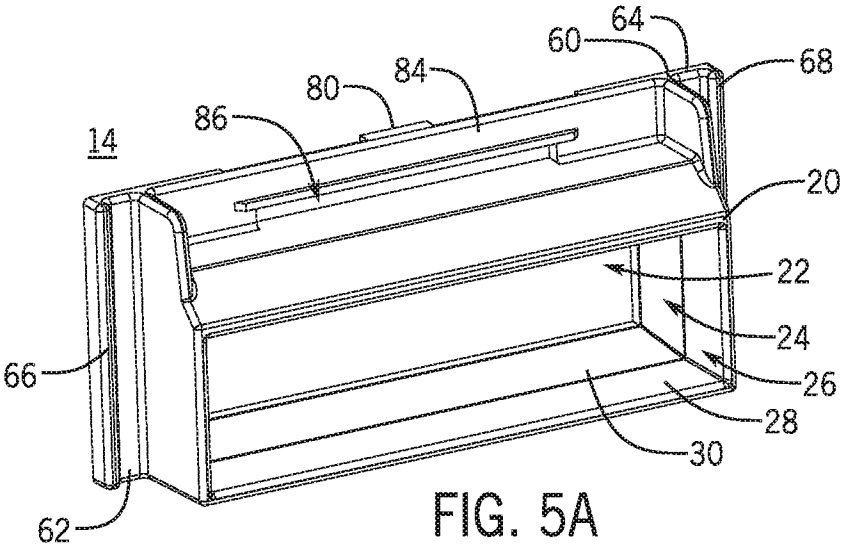

In some embodiments, an adapter can include a conductor passage that extends a substantial distance through the adapter body 20. For example, as illustrated in FIGS. 5A through 5C in particular, the adapter body 20 defines a conductor passage 24 that extends between the adapter opening 22 (i.e., an inner opening in the embodiment illustrated) and another adapter opening 26 (i.e., an outer opening in the embodiment illustrated). In the embodiment illustrated, the adapter opening 26 is generally larger than the adapter opening 22. Accordingly, the conductor passage 24 generally narrows along the direction extending from the adapter opening 26 to the adapter opening 22. This can be useful, for example, in order to help guide a conductor through, retain a conductor in, or block a conductor from passing fully through, the conductor passage 24.

In different embodiments, a narrowing conductor passage can be configured in different ways. As illustrated in FIGS. 5A through 5C, for example, the conductor passage 24 includes a plurality of discrete portions with different geometries. In particular, the adapter body 20 includes an outer conductor-passage frame portion 28 extending from the opening 26, and an inner conductor-passage frame portion 30 extending from the passage frame portion 28 to the inner opening 22. Further, the outer conductor-passage frame portion 28 extends with a substantially constant cross-section and the inner conductor-passage frame portion 30 tapers linearly inwardly on all sides to meet the opening 22. As also discussed below, this arrangement can, for example, usefully admit certain insulated conductors into the housing 12 and help to secure those conductors during installation. In other embodiments, other configurations are possible. For example, in some embodiments, the narrowing of a conductor passage can be continuous or may be at least partly non-linear, or no narrowing may be provided.

In different embodiments, an adapter can be configured to move relative to a housing in different ways. In the embodiment illustrated, for example, the adapter 14 is configured to be slidably retained on the housing 12, so that the adapter 14 can slide between the open configuration of FIGS. 1 and 3 and the closed configuration of FIGS. 2 and 4. In other embodiments, as also discussed below, other configurations are possible.

Figure 2:
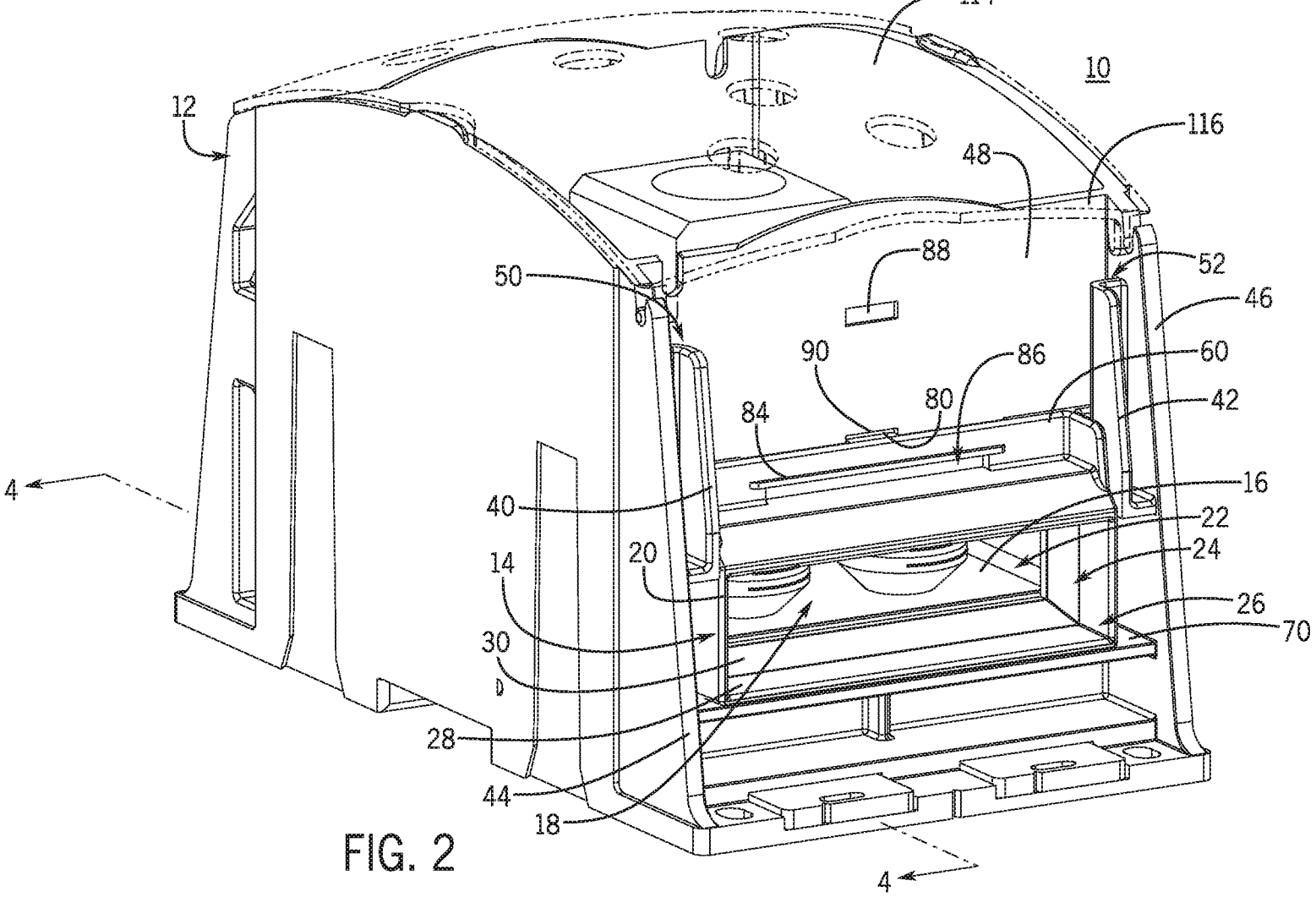
FIG. 2 is a front isometric view of the splice block assembly of FIG. 1, with the adapter in a closed configuration.
Figure 3:
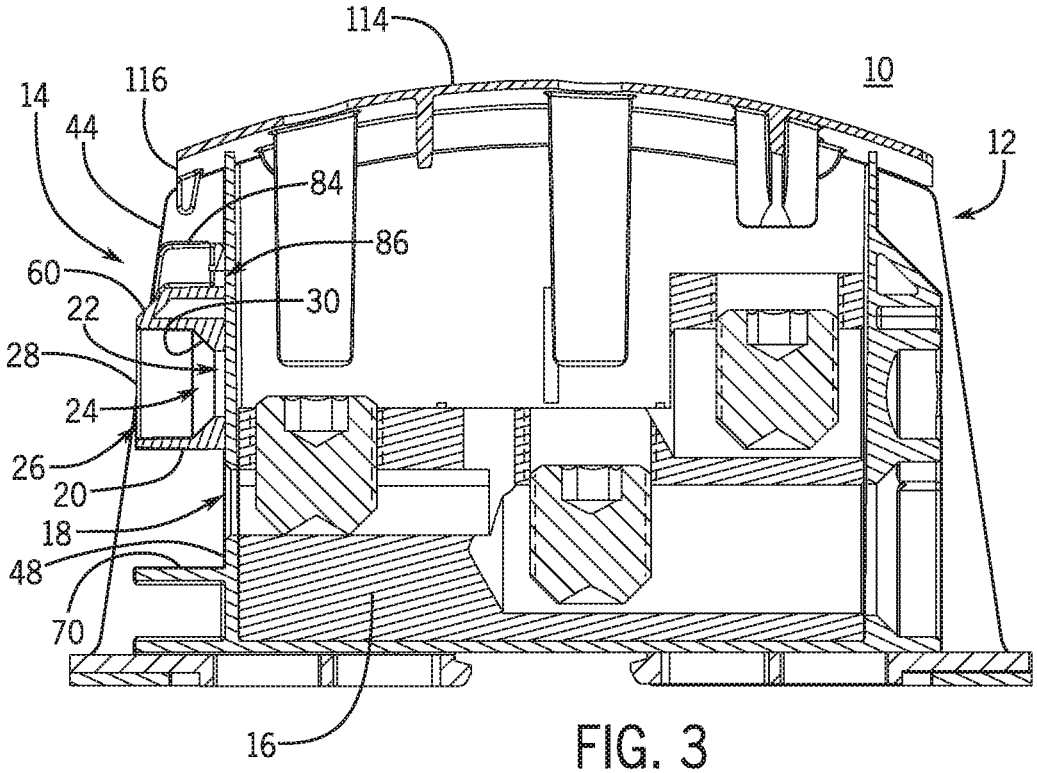
FIG. 3 is a sectional, right side view of the splice block assembly of FIG. 1 with the adapter in the open configuration, taken along plane 3-3 of FIG. 1.

In the embodiment illustrated, the adapter 14 and the housing 12 are configured with generally complimentary engagement features, to facilitate slidable retention and adjustment of the adapter 14 on the housing 12. As illustrated in FIGS. 1 and 2 in particular, the housing 12 includes support members configured as arms 40, 42 that extend laterally inward from opposing side walls 44, 46 of the housing 12. Rear surfaces of the arms 40, 42 are disposed with an offset from a front wall 48 of the housing 12, so that the arms 40, 42 form channels 50, 52 between the arms 40, 42 and the front wall 48 to define generally linear tracks for movement of the adapter 14.

Correspondingly, as illustrated in FIGS. 5A through 5C in particular, the adapter body 20 includes an outer frame 60 that surrounds the conductor passage 24 and includes side extensions 62, 64. As illustrated in FIGS. 1 and 2, for example, the side extensions 62, 64 extend sufficiently laterally outwardly relative to the opening 22 to be disposed within the channels 50, 52 when the adapter 14 is installed on the housing 12. Further, referring again to FIGS. 5A through 5C, each of the side extensions includes a slide member, configured respectively as flanges 66, 68 extending at right angles from the side extensions 62, 64.

A combined depth of the flanges 66, 68 and the side extensions 62, 64 is generally selected so that the adapter 14, as installed in FIGS. 1 and 2, is appropriately retained within the channels 50, 52 while still being slidably movable relative to the housing 12, as guided by the channels 50, 52. For example, the side extensions 62, 64 and the flanges 66, 68 can be configured so that the flanges 66, 68 can generally remain in contact with the arms 40, 42, throughout adjustment of the adapter 14, in order to generally provide support and guidance for the adjustment (see, e.g., FIGS. 6A and 6B).

In some embodiments, other arrangements can help to movably secure an adapter relative to a housing. For example, as illustrated in FIGS. 1 through 4 and 6A through 7, side walls of the adapter body 20 to the lateral sides of the conductor passage 24 can be configured to engage and slide along laterally inner surfaces of the arms 40, 42 as the adapter 12 is moved between the open and closed configurations. This engagement, for example, can complement the engagement of the flanges 66, 68 within the channels to appropriately secure and guide the adapter 14 relative to the housing 12.

In other embodiments, other configurations are possible. For example, in some embodiments, a track to guide movement of an adapter can be angled, curved, or otherwise configured differently from the generally linear tracks defined by the channels 50, 52. In some embodiments, as also discussed below, an adapter can be configured to move relative to a housing in other ways.

Figure 4:
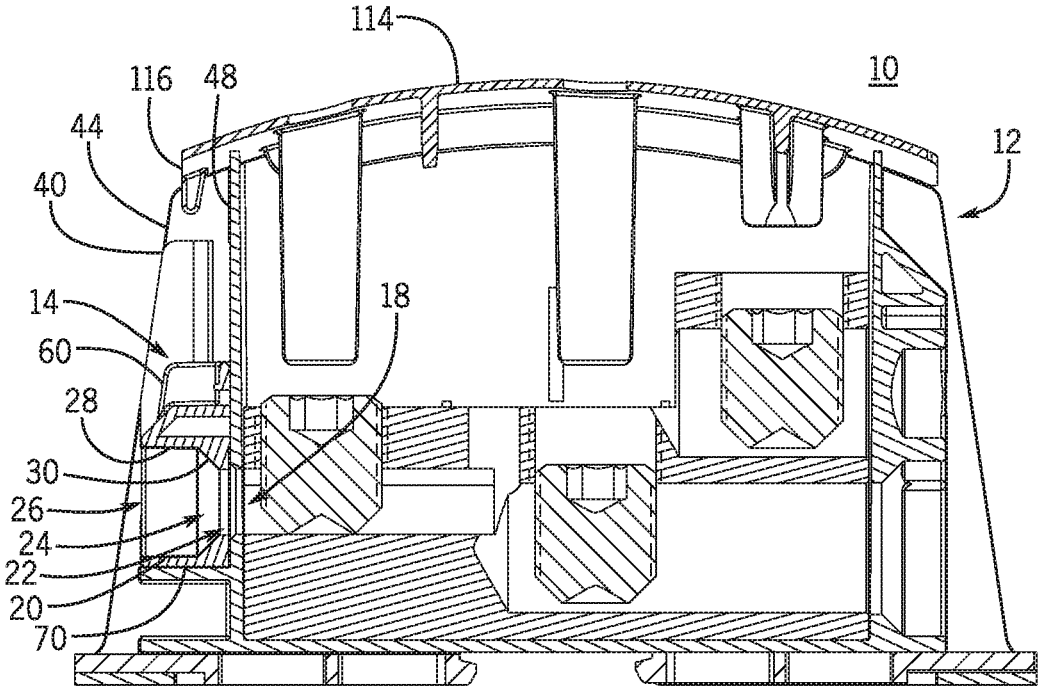
FIG. 4 is a cross-sectional, right side view of the splice block assembly of FIG. 1 with the adapter in the closed configuration, taken along plane 4-4 of FIG. 2.

In some embodiments, other features on an adapter or an associated housing can help to guide movement of an adapter or to retain the adapter in particular configurations. For example, as illustrated in FIGS. 2 and 4 in particular, the adapter 14 can rest upon a stop surface 70 of the housing 12, when in the closed configuration, in order to ensure that the conductor passage 24 and the adapter body 20, generally, are appropriately and securely aligned with the housing opening 18.

As another example, as also noted above, an adapter and an associated housing can include engagement features, such as protrusions and corresponding recesses, that are configured to temporarily secure the adapter at a particular orientation relative to the housing. For example, as illustrated in FIG. 5B in particular, an angled protrusion 80 extends from a flat rear wall 82 of the adapter 14.

In particular, in the embodiment illustrated, the protrusion 80 extends rearward from an extended support structure 84 of the adapter body 20, which is largely separated from the structures of the conductor passage 24 by an opening 86. In some embodiments, the relative thickness of the support structure 84 and the configuration of the opening 86 can allow the support structure 84 to flex relatively easily away from the housing 12 while the adapter body 20 remains secured to the housing by the arms 40, 42. This can be useful, for example, to help move the protrusion 80 away from the housing 12 and out of engagement with a corresponding engagement feature on the housing 12.

As illustrated in FIGS. 1 and 2 in particular, the housing 12 includes a plurality of additional engagement features that are configured as recesses 88, 90 that extend into the front wall 48. The recesses 88, 90 are generally complimentary to the protrusion 80, in order to receive the protrusion 80, depending on the orientation of the adapter 14, and thereby temporarily secure the adapter 14 in a particular configuration. In the embodiment illustrated, for example, the recess 88 is configured to receive the protrusion 80 to secure the adapter 14 at the open configuration (see, e.g., FIG. 1) and the recess 90 is configured to receive the protrusion 80 to secure the adapter 14 at the closed configuration (see, e.g., FIG. 2). In this way, for example, the adapter 14 can be removably held in either an open or a closed configuration (or otherwise), as desired.

In different embodiments, engagement features can be engage with and disengaged from each other in different ways. For example, in some embodiments, the protrusion 80 can be configured to removably engage the recesses 88, 90 with a snap-in connection. Similarly, in some embodiments, the flexibility of the support structure 84 relative to the remainder of the adapter body 20 (see, e.g., FIG. 5B) can allow the protrusion 80 to be manually disengaged from the recesses 88, 90. For example, as also discussed above, the configuration of the opening 86 and the thickness of the support structure 84 can be selected to provide appropriate flexibility for the support structure 84 to allow the support structure 84 to readily flex relative to the remainder of the adapter body 20, in response to a manually applied force, in order to engage or release the protrusion 80 relative to the recesses 88, 90.

For some embodiments, the support structure 84, the protrusion 80, and the recesses 88, 90 can be configured so that a flat tool (e.g. a flat-head screwdriver) can be used to uncouple the protrusion 80 from the recesses 88, 90. For example, in some embodiments, a flat tool can be readily inserted between the housing 12 and the support structure 84, in order to thereby manually apply a force to uncouple the protrusion 80 from the recess 88, 90. This can be beneficial during installation, for example, in order to easily place the adapter 14 into the appropriate open or closed configuration.

In other embodiments, other configurations are possible. In some embodiments, other recesses can be disposed on the housing 12 in order to temporarily secure the adapter 14 at orientations other than those shown in FIGS. 1 and 2. For example, in some embodiments, recesses on the housing 12 can allow the adapter 14 to be selectively disposed at various stages between the illustrated open configuration (see, e.g., FIG. 1) and closed configuration (see, e.g., FIG. 2). In some embodiments, other types of engagement features can be used. For example, one or more protrusions can be included on a housing, and one or more corresponding recesses can be included on an associated adapter.

Figure 6A:
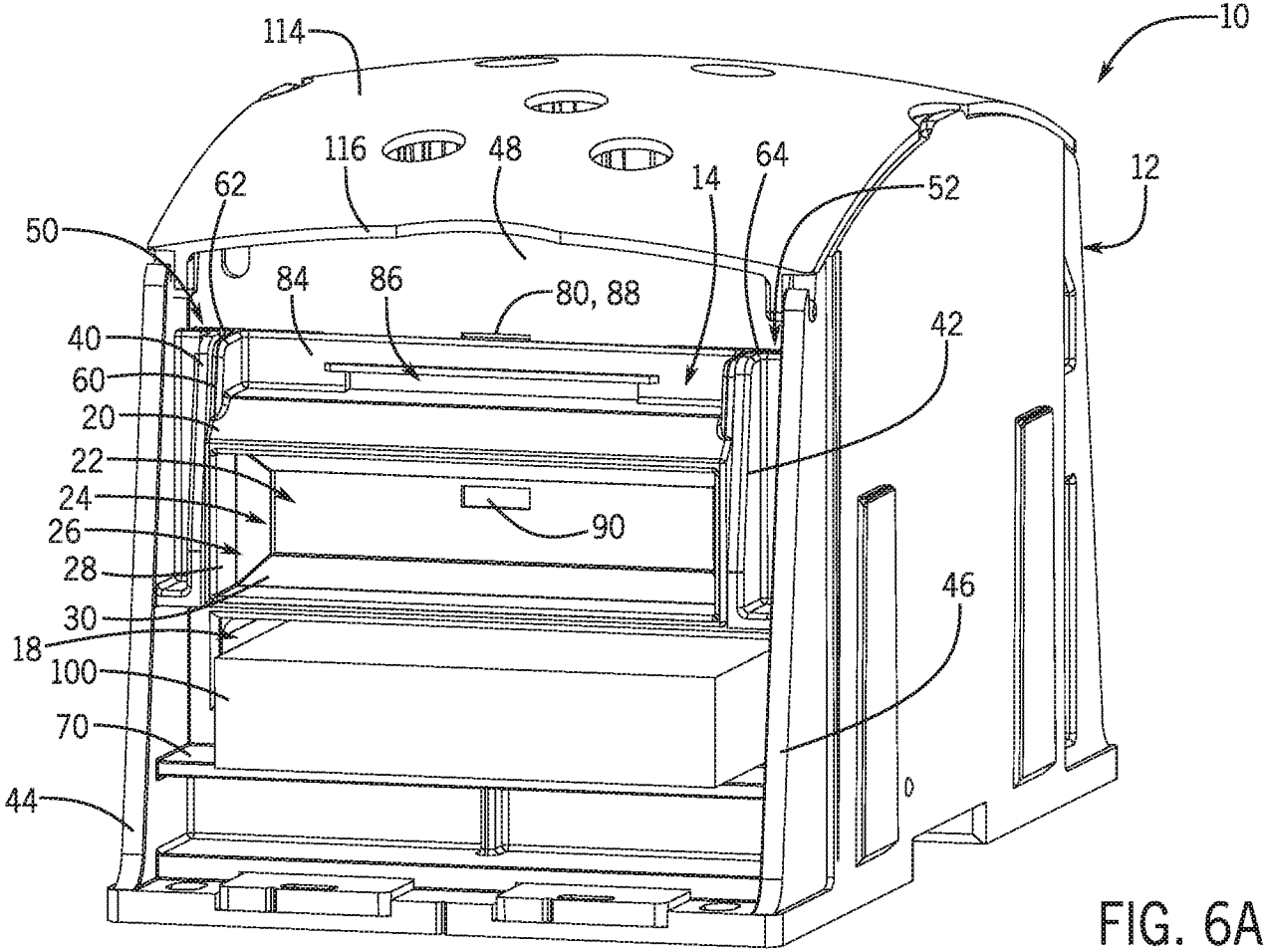
FIGS. 6A and 6B are front isometric partial views of the splice block assembly of FIG. 1, with the adapter in the open configuration and with different sizes of flexible busbar installed.

As also noted above, use of an adapter according to the invention, such as the adapter 14, can allow a housing to receive and secure conductors of a wide range of sizes in a finger-safe or otherwise appropriate manner. For example, as illustrated in FIG. 6A, with the adapter 14 in the open configuration, the housing 12 can receive, via the opening 18, a rectangular busbar 100 with a relatively large width and height (i.e., a relatively large cross-section). Further, due to a close correspondence between the cross-section of the busbar 100 and the size of the housing opening 18, there is relatively little space between the busbar and the inner perimeter of the opening 18. Accordingly, the housing 12 may be considered finger-safe (or otherwise appropriately configured) at the opening 18 when the busbar 100 is installed.

Figure 6B:
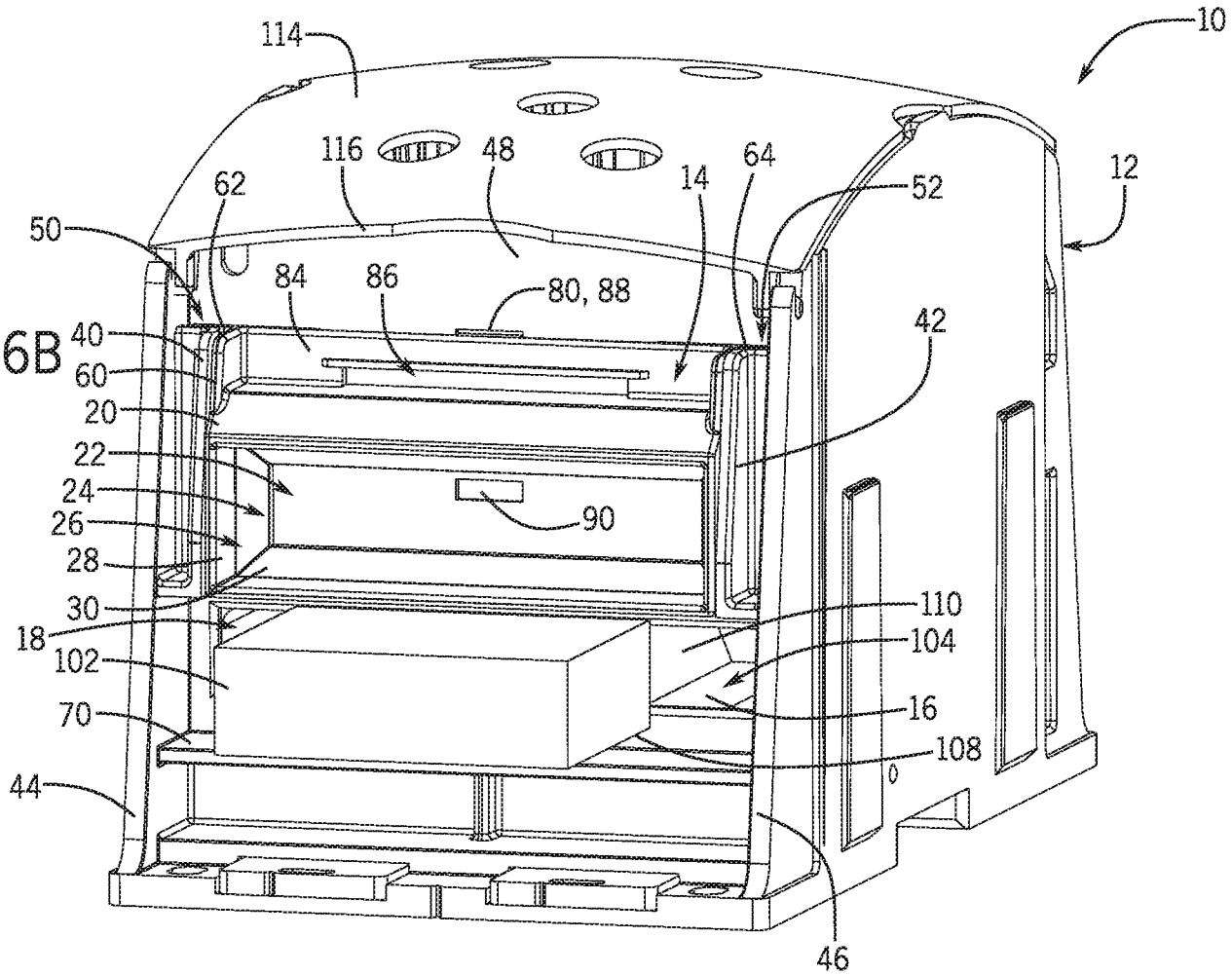

In contrast, for example, with the adapter 14 in the open configuration, as illustrated in FIG. 6B, the housing 12 can receive, via the opening 18, a rectangular busbar 102 with a somewhat smaller width than the busbar 100 (i.e., a relatively smaller cross-section). As a result, there may be a relatively large gap 104 between the busbar 102 and the lateral side walls of the opening 18. If the gap 104 is sufficiently large, the housing 12 may accordingly not be considered finger-safe (or otherwise appropriately configured) at the opening 18 when the busbar 102 is installed.

Figure 7:
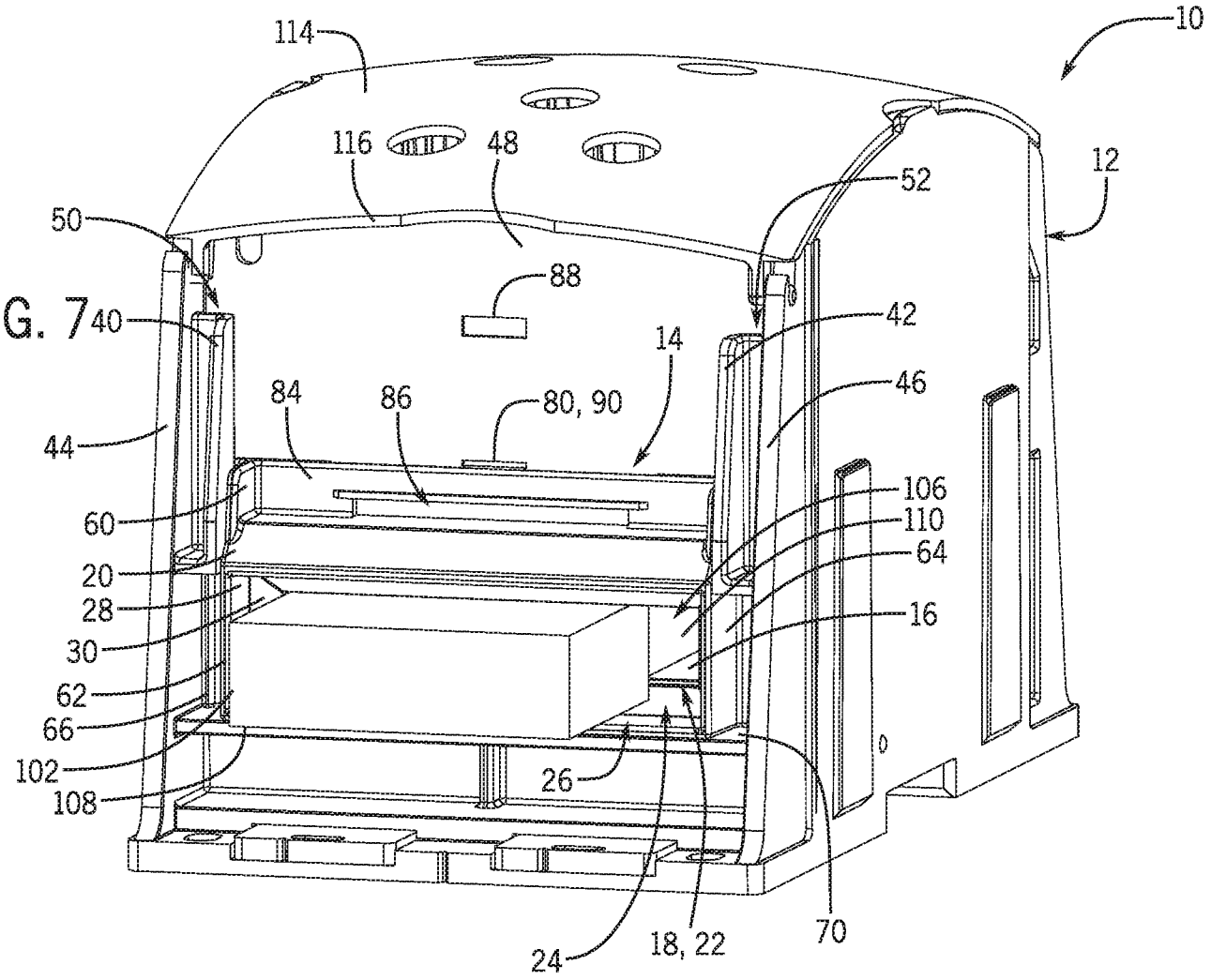
FIG. 7 is a front isometric partial view of the splice block assembly of FIG. 1, with the adapter the closed configuration and with the flexible busbar of FIG. 6B installed.

In some embodiments, however, it may be desirable to use the housing 12 sometimes with the busbar 102 rather than with the busbar 100. Accordingly, for example, as illustrated in FIG. 7, the adapter 14 can be moved to the closed configuration, and the busbar 102 can be inserted into the housing 12 via the conductor passage 24 as well as the opening 18. As a result, a gap 106 between the busbar 102 and the lateral side walls of the smaller of the openings 22, 26 (e.g., the opening 22) may be sufficiently small that the housing 12 may again be considered finger-safe at the opening 18. In this light, for example, before installation of a conductor through the opening 18, a user can first determine whether the adapter 14 should be in the open or closed configuration, based on the size of the conductor, and then adjust the adapter appropriately.

In some embodiments, a relatively large different between a width of a conductor and the width of the opening 18 (e.g., as illustrated by the gap 104 of FIG. 6B) can introduce other issues. For example, the relatively large size of the gap 104 may indicate a possibility of lateral misalignment of the busbar 102, with a corresponding relatively poor (e.g., mechanically unstable) connection between the busbar 102 and the block 16 (see, e.g., FIG. 1). The adapter 14 can also be helpful in this regard, as illustrated in FIG. 7, by more appropriately orienting (e.g., centering) the busbar 102 within the opening 18 and the assembly 10 in general.

In some embodiments, as also noted above, the geometry of a conductor passage can be configured to help to secure a conductor within the relevant adapter and/or splice block assembly generally. For example, as illustrated in FIG. 7, the adapter opening 26 is generally large enough to fully receive an outer insulation layer 108 of the busbar 102. In contrast, the adapter opening 26 and an inner portion of the conductor-passage frame portion 30 are generally large enough to fully receive a conductive core 110 of the busbar 102, but are generally too small (e.g., in height) to fully receive the insulation layer 108 (i.e., are configured to block passage of the insulation layer 108 therethrough).

Accordingly, upon sufficient insertion of the busbar 102, the insulation layer 108 can be blocked from further insertion by contact with the conductor-passage frame portion 30, with an exposed end of the conductive core 110 extending onward through the openings 26, 18 to engage the block 16 (see, e.g., FIG. 1). Thus, for example, the adapter 14 can help to prevent over-insertion of the busbar 102 or can provide to users a tactile indication that the busbar 102 is appropriately oriented for the end of the core 110 to be secured within the housing 12. In some embodiments, the engagement of the insulation layer 108 by the conductor-passage frame portion 30 can additionally (or alternatively) help to hold the busbar 102 in place relative to the housing 12. For example, with appropriate insertion of the busbar 102, the tapered profile of the conductor-passage frame portion 30 can grip the insulation layer 108 in order to generally secure the busbar 102 in place while a user directly secures the core 110 to the conductive block 16.

As generally discussed above, in some embodiments, an adapter according to the invention can be removably coupled to a splice block housing, such as through engagement of the adapter 14 by the arms 40, 42 (see, e.g., FIG. 1). In some embodiments, other features of a splice block assembly, including movable features, can help to removably secure the adapter to the relevant housing. As illustrated in FIGS. 1 and 2, for example, the splice block assembly 10 includes a cover 114 for the housing 12 that can help to secure the adapter 12 in place. In the embodiment illustrated, the cover 114 is configured to be removably secured in a closed orientation over the housing 12. Further, when closed, the cover 114 is configured to provide an overhang 116 that extends forward of the front wall 48 of the housing 12.

In some configurations, the overhang 116 can extend into a path of the adapter 14, as prescribed, for example, by the channels 50, 52. Accordingly, even if the adapter 14 is accidentally moved upwards from the position illustrated in FIG. 1, the overhang 116 can generally block the full removal of the adapter 14 from the housing 12. As appropriate, for example, the adapter 14 can then be fully removed from the housing 12 by opening the cover 114, or otherwise moving the overhang 116 out of the path of the adapter 14, and sliding the adapter 14 fully free of the arms 40, 42.

Figure 8:
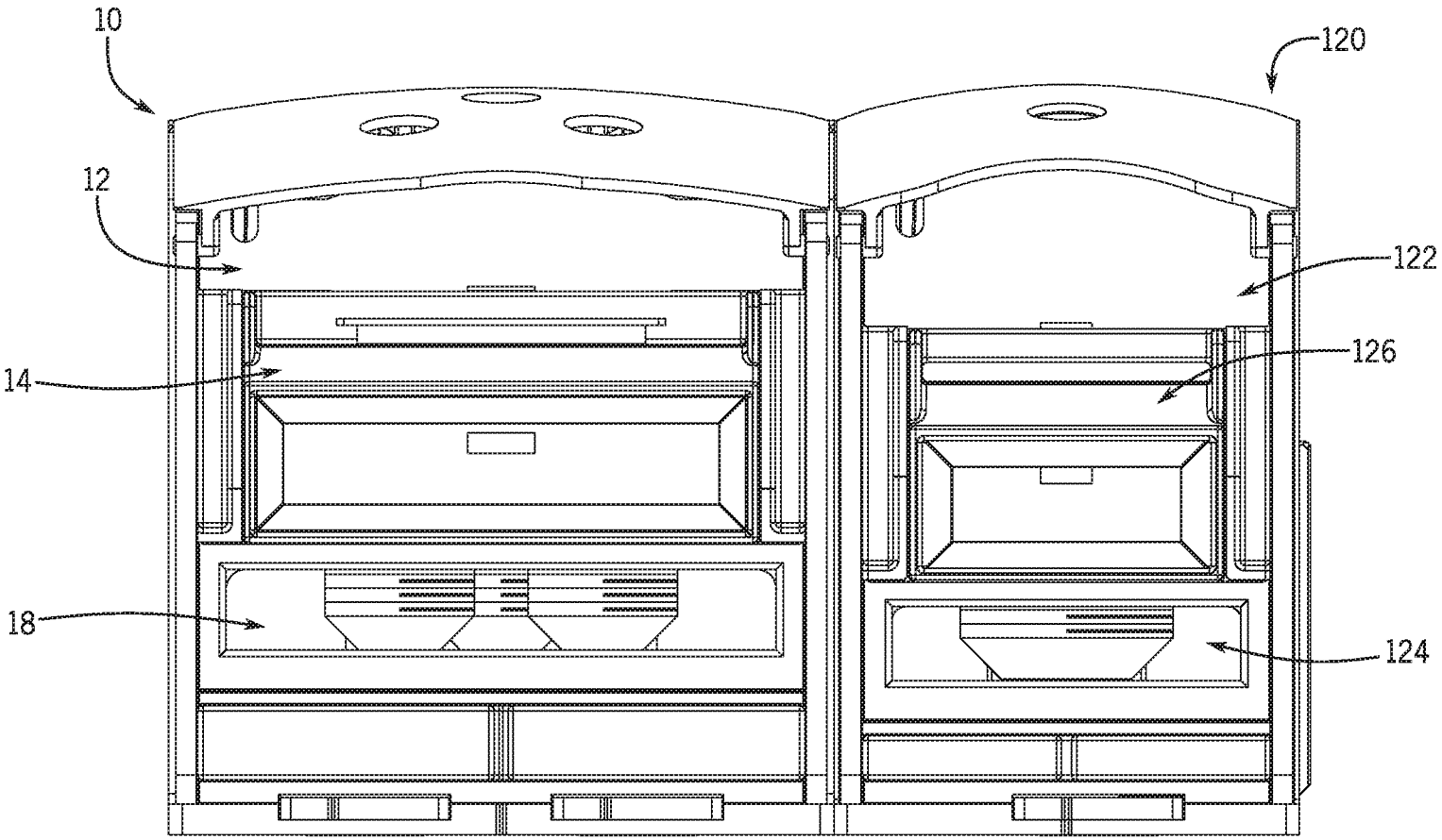
FIG. 8 is a front elevation view of the splice block assembly of FIG. 1 and another splice block assembly with an adapter, according to another embodiment of the invention.

Also as noted above, different embodiments of an adapter according to the invention can exhibit different sizes and dimensions. As illustrated in FIG. 8, for example, the splice block assembly 10 can be secured in lateral engagement with a narrower splice block assembly 120. In the embodiment illustrated, the splice block assembly 120 includes a housing 122 with an opening 124, configured generally similarly to the housing 12, and a slidable adapter 126 that is configured to operate relative to the housing 122 and the opening 124 generally similarly to the adapter 14 relative to the housing 12 and the housing opening 18. In some embodiments, the splice block assembly 120 can be used independently of the splice block assembly 10, or in combination with other instances of the assembly 120, or other splice block assemblies according to the invention.

In other embodiments, other configurations are possible. For example, other splice block assemblies according to the invention can exhibit a variety of sizes, housing types, internal connections, configurations of housing openings, and other features that are different from those illustrated in FIGS. 1 through 8. Similarly, other adapters according to the invention can also exhibit a variety of sizes, housing types, internal connections, configurations of housing openings, and other features that are different from those illustrated in FIGS. 1 through 8.

Generally, the size of a particular adapter can be selected based on the size of the relevant splice block opening, and the range of conductor shapes or sizes that are expected to be accommodated. For example, a particular adapter can be selected based upon the size and shape of an adapter opening or a conductor passage of the adapter, so that when the adapter is in the closed position and receives an expected smallest-size conductor, the associated splice block assembly generally remains finger-safe or otherwise appropriately configured.

In some embodiments, an adapter according to the invention can be manufactured using plastic. For example, the adapter 14 can be formed as a single-piece, single-material plastic body. In other embodiments, other configurations and/or materials may be possible.

In some embodiments, an adapter according to the invention can be configured to move between open and closed configurations in ways other than those illustrated in FIGS. 1 through 8. For example, FIG. 9A illustrates an example splice block assembly 130 according to an embodiment of the invention, with a housing 132, a housing opening 134, and an adapter 136. In the embodiment illustrated, the adapter 136 is configured to rotate, about a pin 138, between an open configuration (as shown) and a closed configuration (e.g., similar to the closed configuration of FIG. 2).

Figure 9B:
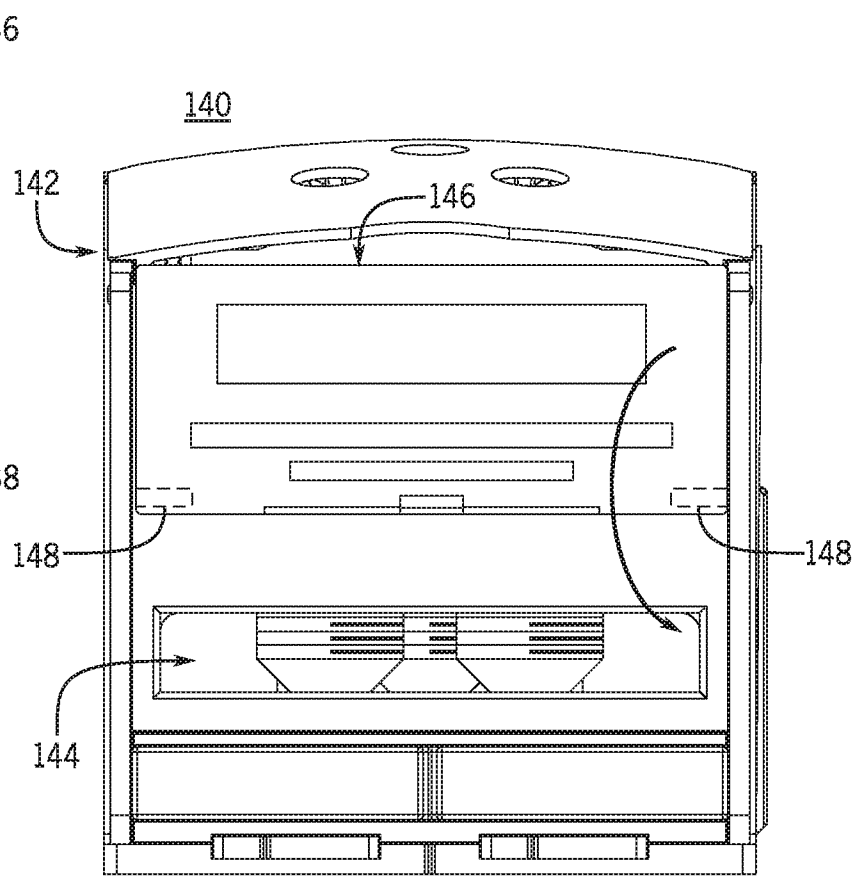
FIGS. 9A and 9B are schematic views of splice block assemblies according to further embodiments of the invention.
Figure 9A:
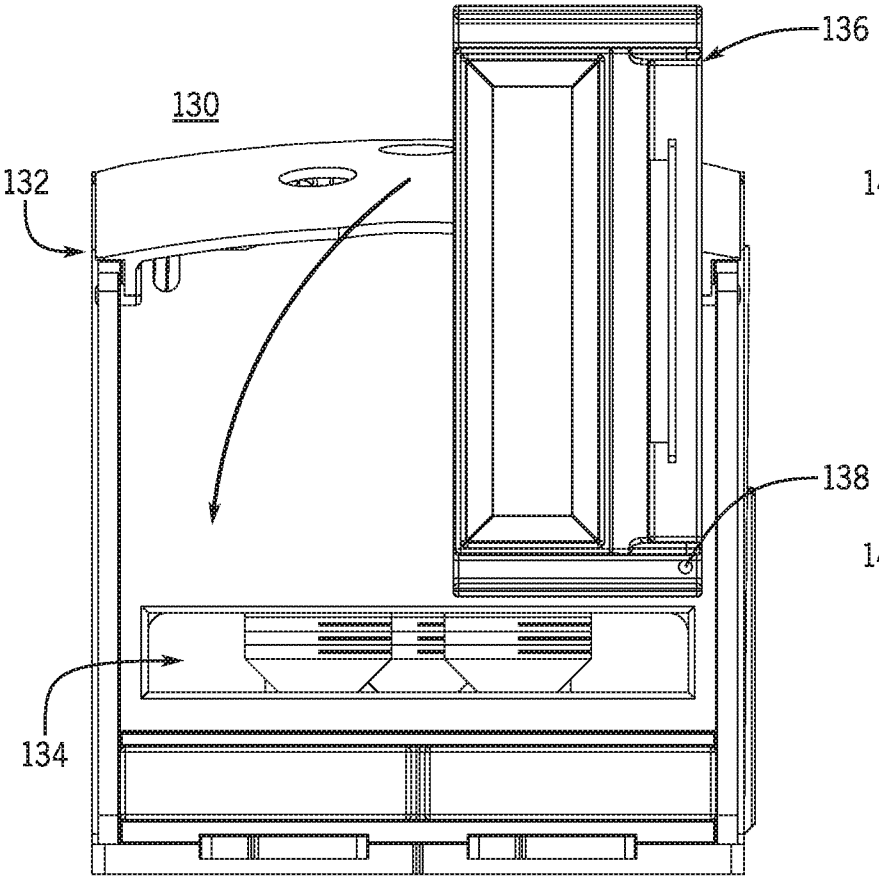

As another example, FIG. 9B illustrates an example splice block assembly 140 according to an embodiment of the invention, with a housing 142, a housing opening 144, and an adapter 146. In the embodiment illustrated, the adapter 146 is configured to hinge, about hinge pins 148, between an open configuration (as shown) and a closed configuration (e.g., similar to the closed configuration of FIG. 2). In other embodiments, other configurations are possible.

Thus, embodiments of the invention can provide splice blocks with generally increased adaptability, as compared to conventional splice blocks. For example, embodiments of the invention can help to maintain a splice block's IP20 (or other) rating, while still allowing the splice block to selectively receive relatively large and relatively small conductors. Similarly, in some embodiments, users can be provided with the ability to selectively use an adapter or not, as appropriate for a particular conductor, such as by sliding or otherwise moving the adapter between open and closed configurations. In some embodiments, an adapter can be removed from the housing entirely, or can be configured to be installed on existing housing (i.e., installed as a retrofit). In this way, a wide variety of splice blocks can be used in a wide variety of applications without compromising the IP20 (or other) rating.

It will be appreciated by those skilled in the art that while the invention has been described above in connection with particular embodiments and examples, the invention is not necessarily so limited, and that numerous other embodiments, examples, uses, modifications and departures from the embodiments, examples and uses are intended to be encompassed by the claims attached hereto.

Various features of the invention are set forth in the following claims.

The invention claimed is:

1. An adapter to selectively allow insertion of a first conductor of a first cross-sectional size and a second conductor of a second cross-sectional size into a splice block housing via a housing opening in the splice block housing, the first cross-sectional size being larger than the second cross-sectional size, the adapter comprising:

an adapter body that is movably retained on the splice block housing and that includes a first adapter opening that is smaller than the housing opening;

the adapter body being movable relative to the splice block housing from an open configuration to a closed configuration;

the adapter body, in the open configuration, being disposed to permit the first conductor to be inserted into the splice block housing via the housing opening; and the adapter body, in the closed configuration, being disposed to block insertion of the first conductor into the splice block housing via the housing opening, with the first adapter opening aligned for insertion of the second conductor into the splice block housing via the first adapter opening and the housing opening, and wherein the adapter body includes a second adapter opening and a conductor passage that extends between the first adapter opening and the second adapter opening, and wherein the conductor passage narrows from a perspective moving through the conductor passage towards the splice block housing.

2. The adapter of claim 1, wherein, in the open configuration the adapter body is substantially clear of the housing opening.

3. The adapter of claim 1, wherein the adapter body is slidably retained on the splice block housing in order to slide between the closed configuration and the open configuration.

4. The adapter of claim 1, for use with the splice block housing that includes at least one of a housing protrusion or a housing catch, wherein the adapter body includes, respectively, at least one of:

an adapter protrusion configured to engage the housing catch to temporarily secure the adapter body in at least one of the open configuration or the closed configuration; or an adapter catch configured to engage the housing protrusion to temporarily secure the adapter body in at least one of the open configuration or the closed configuration.

5. The adapter of claim 1, wherein the adapter body includes a second adapter opening and a conductor passage that extends between the first adapter opening and the second adapter opening.

6. The adapter of claim 5, wherein an inner one of the first and second adapter openings is smaller than an outer one of the first and second adapter openings.

7. The adapter of claim 6, for use with a busbar with an outer insulation layer, wherein the adapter body is configured to admit the busbar into the splice block housing via the conductor passage;

wherein the outer one of the first and second adapter openings is configured to receive the outer insulation layer therethrough; and wherein the inner one of the first and second adapter openings is configured to block the outer insulation layer.

8. The adapter of claim 1, with the housing opening being a substantially rectangular opening with a first width, wherein the first adapter opening is a substantially rectangular opening with a second first width smaller than the first width.

9. A splice block assembly for use with a conductive block, a first conductor, and a second conductor, the first conductor having a larger cross-sectional profile than the second conductor, the splice block assembly comprising:

a housing that is configured to insulate the conductive block, the housing including a housing opening configured to admit either of the first and second conductors into the housing; and an adapter body that is movably coupled to the housing and includes a first adapter opening that is configured not to admit the first conductor therethrough;

the adapter body being selectively movable relative to the housing between:

an open configuration, in which the adapter body is disposed with the first adapter opening out of alignment with the housing opening, to allow either of the first and second conductors to extend into the housing via the housing opening; and a closed configuration in which the adapter body is in alignment with the housing opening, to block insertion of the first conductor through the housing opening and to admit the second conductor into the housing opening via the first adapter opening.

10. The splice block assembly of claim 9, wherein at least one of the housing opening and the adapter opening is substantially rectangular.

11. The splice block assembly of claim 10, wherein the housing opening is configured to accept a substantially rectangular busbar.

12. The splice block assembly of claim 9, wherein the adapter body is configured to rotate between the open and closed configurations.

13. The splice block assembly of claim 9, wherein the adapter body is configured to hinge between the open and closed configurations.

14. The splice block assembly of claim 9, wherein the adapter body is configured to slide between the open and closed configurations.

15. The splice block assembly of claim 9, wherein the adapter body includes a second adapter opening and a conductor passage that extends between the first adapter opening and the second adapter opening.

16. The splice block assembly of claim 15, wherein the conductor passage narrows from a perspective moving through the conductor passage towards the housing.

17. The splice block assembly of claim 9, wherein the housing opening is fully enclosed by the housing; and wherein the adapter opening is fully enclosed by the adapter body.

18. A splice block assembly for use with a conductive block, a first busbar, and a second busbar, the first busbar having a rectangular cross-sectional profile that is larger than a rectangular cross-sectional profile of the second busbar, the splice block assembly comprising:

a housing that is configured to insulate the conductive block, the housing including a first housing track and a housing opening, the housing opening being configured to admit either of the first and second busbars into the housing to engage the conductive block;

an adapter body that includes an outer frame and a first adapter opening, at least part of the outer frame being slidably received within the first housing track of the housing to guide sliding movement of the adapter body between an open configuration and a closed configuration;

the adapter body, in the open configuration, being disposed to permit the first busbar to be inserted into the housing via the housing opening; and the adapter body, in the closed configuration, being disposed to block insertion of the first busbar into the housing via the housing opening, with the first adapter opening aligned for insertion of the second busbar into the housing via the first adapter opening and the housing opening.

19. The splice block assembly of claim 18, wherein each of the housing opening and the first adapter opening is a fully enclosed opening.

20. The splice block assembly of claim 19, wherein the housing includes a second housing track opposite the housing opening from the first housing track; and wherein at least part of the outer frame of the adapter body is slidably received within the second housing track to guide sliding movement of the adapter body between the open and closed configurations.

* * * * *